United States Patent [19]

Pfister

[11] 3,989,022

[45] Nov. 2, 1976

[54] FUEL METERING MEANS FOR CHARGE FORMING DEVICES FOR INTERNAL COMBUSTION ENGINES

[76] Inventor: Arthur Franklin Pfister, 10 Cynthia Lane, Center Moriches, Suffolk County, N.Y. 11934

[22] Filed: Nov. 2, 1973

[21] Appl. No.: 412,336

[52] U.S. Cl. ..... 123/139 AR; 123/139 R; 123/179 G; 123/198 DB

[51] Int. Cl.[2] ..... F02M 39/00

[58] Field of Search ..... 123/139 AB, 139 AE, 123/139 AP, 139 AR, 139 R, 139 AA, 198 C, 198 D, 198 DB

[56] References Cited

UNITED STATES PATENTS

| | | | |
|---|---|---|---|
| 1,640,509 | 8/1927 | Lowe | 123/139 AE |
| 1,912,367 | 6/1933 | Hesselman | 123/139 AE |
| 1,934,108 | 11/1933 | Walker | 123/139 |
| 1,953,449 | 4/1934 | Thele et al. | 123/139 AA |
| 1,974,851 | 9/1934 | Hurst | 123/139 AA |
| 2,077,185 | 4/1937 | Renner | 123/139 AA |
| 2,147,390 | 2/1939 | Vaudet | 123/139 AR |
| 2,535,535 | 12/1950 | Fleck | 123/139 AE |

FOREIGN PATENTS OR APPLICATIONS

| | | | |
|---|---|---|---|
| 460,189 | 5/1928 | Germany | 123/139.1 |
| 82,920 | 1/1935 | Sweden | 123/139 AB |
| 904,910 | 9/1962 | United Kingdom | 123/139 AA |
| 664,419 | 1/1952 | United Kingdom | 123/139.13 |
| 310,012 | 3/1930 | United Kingdom | 123/139 AB |

*Primary Examiner*—Charles J. Myhre
*Assistant Examiner*—Paul Devinsky
*Attorney, Agent, or Firm*—Darby & Darby

[57] ABSTRACT

Apparatus, for metering a predetermined amount of fuel for injection into a combustion engine, having a plunger slidable within a metering chamber wherein fuel is drawn into the metering chamber when the plunger is withdrawn from the chamber to an outer position and fuel is pumped from the metering chamber into the combustion engine when the plunger is forced into the metering chamber to an innermost position. An adjustable governor is provided for variably limiting the degree of withdrawal of the plunger from the metering chamber to regulate the metered amount of fuel. A rotating cam driven by the combustion engine normally maintains the plunger at its innermost position within the metering chamber to permit free adjustment of the governor and permits withdrawal of the plunger to allow the metering chamber to fill with fuel only immediately prior to the pumping stroke wherein the plunger is forced into the chamber causing the metered fuel to enter the combustion engine.

5 Claims, 4 Drawing Figures

FUEL METERING MEANS FOR CHARGE FORMING DEVICES FOR INTERNAL COMBUSTION ENGINES

BACKGROUND OF THE INVENTION

This invention applies to charge forming devices which are composed of one or more reciprocating plunger elements, as a pump means, and employ, as a fuel metering means, variation of the length of the fuel inlet stroke of the plunger elements. Examples of such devices are found in U.S. Pat. Nos. 1.834,224 and 1,912,367.

It is known in the prior art to meter a predetermined amount of fuel for injection into a combustion engine by filling a chamber of predetermined size and then pumping the fuel in the chamber into the engine. In such devices, a plunger is translated from an innermost position within the chamber to an outer position to permit a predetermined amount of fuel to enter the chamber. At an appropriate time in the engine cycle, the plunger is translated into the chamber forcing the fuel previously stored therein to enter the combustion engine.

The predetermined quantity of metered fuel for injection into the combustion engine is metered by limiting the maximum withdrawal of the plunger from the metering chamber. That is, the greater the degree of withdrawal of the plunger from the metering chamber permitted, the greater the amount of fuel that is drawn into the metering chamber. Similarly, the lesser the amount of withdrawal of the plunger that is permitted, the lesser is the quantity of fuel that can be drawn into the metering chamber when the plunger is in its withdrawn position.

The prior art employs a governor to limit the amount of withdrawal of the plunger thereby regulating the amount of metered fuel to be injected into the engine. In the prior art devices, after fuel is pumped from the metering chamber into the combustion engine, the plunger withdraws from the chamber the full permissible amount permitted by the governor at which time a new charge of fuel is drawn into the metering chamber. The plunger dwells in its outermost position until the appropriate time in the combustion engine cycle, at which time a cam forces the plunger into the chamber to pump the metered fuel within the chamber into the combustion engine.

It is frequently desired to adjust the governor while the engine is running to further limit the quantity of metered fuel to be injected into the combustion engine as, for example, to reduce engine speed. Since the plunger is normally in its withdrawn position and the metering chamber is normally filled with fuel except for the momentary period when the fuel is pumped from the chamber for injection into the engine, any attempt to adjust the governor so that the maximum amount of withdrawal of the plunger from the chamber is decreased necessitates movement of the plunger into the chamber against the force of the metered fuel stored therein. The resistance encountered by the plunger in moving into the metering chamber as the governor is adjusted is termed "hydraulic blockage".

Hydraulic blockage prevents adjustment of the governor, making the governor ineffective to control engine speed. This deficiency of the prior art makes governor control of engines employing charge-forming devices of the type herebefore described impractical.

This is especially so with multi-cylinder internal combustion engines (and multi-rotor rotary internal combustion engines) wherein at any given moment the plungers in a majority, if not all, of the charge-forming devices associated with the respective cylinders or rotors will encounter hydraulic blockage upon an attempt to limit their withdrawal position by adjustment of a governor.

SUMMARY OF THE INVENTION

The present invention overcomes the above-described deficiencies of the prior art in that it teaches the use of a cam driven by the engine to maintain a plunger in a charge-forming device, during its normal dwell, at its innermost position within a fuel metering chamber until shortly before fuel injection is to occur. By preventing the metering chamber from filling with fuel until the last moment before fuel injection, free adjustment of a governor which limits the maximum withdrawal of the plunger from the chamber without resistance from hydraulic blockage is permitted.

The metering chamber comprises a valve block having an outlet and inlet and a plunger slidable within the valve block to force fuel momentarily stored in the metering chamber, after entering through the inlet valve, out through the outlet valve. The plunger is separably seated on a cam follower which reciprocates vertically in response to the rotation of a partially circular cam. The circumference of the cam is such that the cam follower normally urges the plunger inwardly into the metering chamber and permits the plunger to be withdrawn from the chamber only immediately prior to injection of the fuel in the metering chamber into the combustion engine. A governor which limits maximum withdrawal of the plunger from the chamber thereby determining the outer position of the plunger is adjustable without interference from the plunger which during its dwell is supported on the cam follower and comes into contact with the governor only momentarily prior to being forced inwardly into the chamber by the cam and cam follower for injection of fuel into the engine.

It is therefore an object of the invention to provide a charge-forming device for metering fuel for injection into a combustion engine wherein the quantity of metered fuel may be varied by a governor during engine operation without resistance from hydraulic blockage.

Another object of the invention is to provide a charge-forming device for metering fuel for injection into a combustion engine wherein a charge of fuel is not permitted to enter the metering chamber until immediately prior to injection of the charge of fuel from the metering chamber into the combustion engine.

Other and further objects of the invention will be apparent from the following drawings and description of a preferred embodiment in which like reference numerals are used to indicate like parts in the various views.

DESCRIPTION OF THE PREFERRED EMBODIMENT

Figure 1:
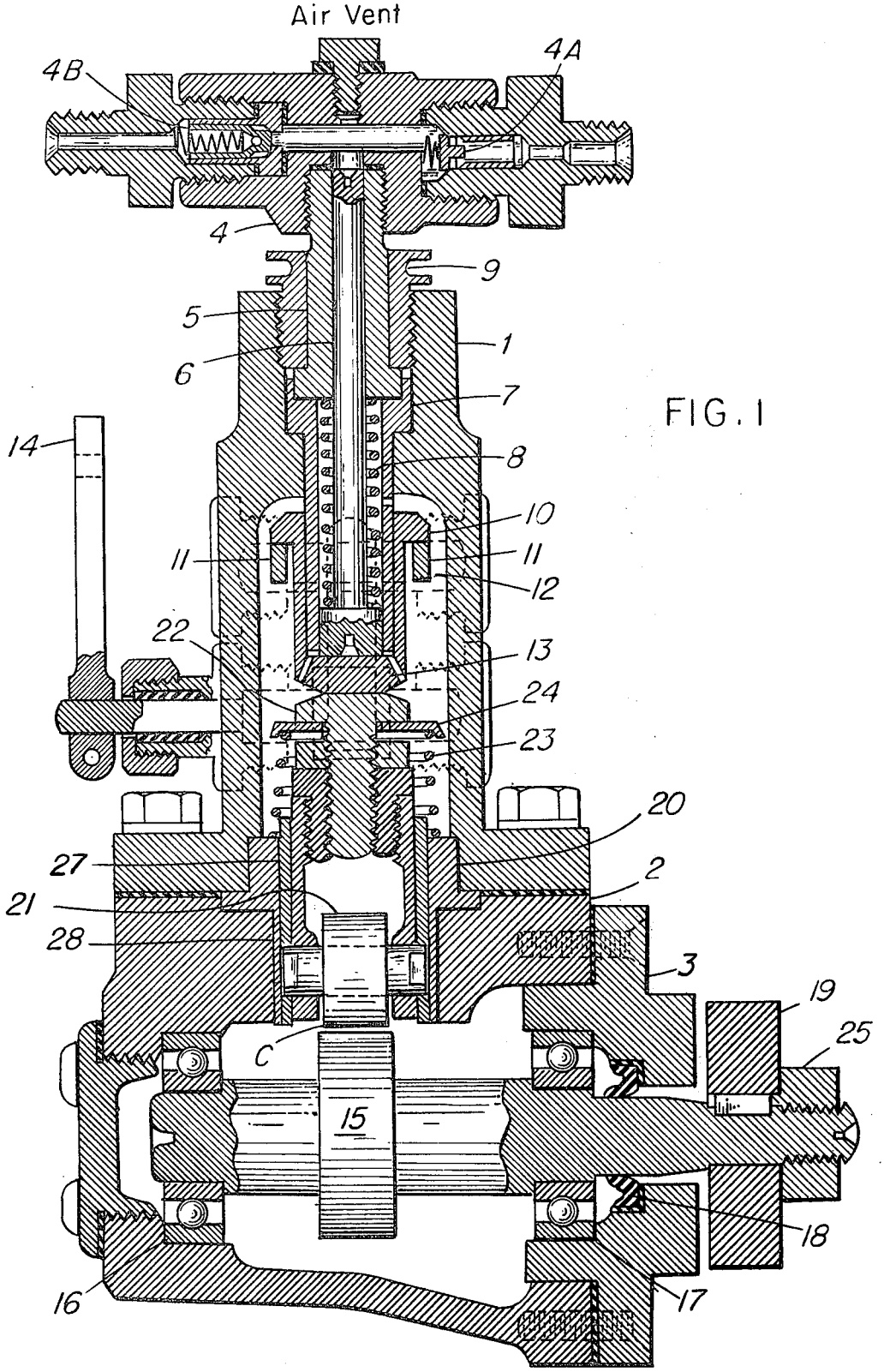
FIG. 1 is a front sectional elevation of the charge-forming device of the invention.

The following description applies primarily to a fuel injection pump, which may be used with a single cylinder, compression ignition engine. However, a multi-cylinder engine application would only require the assembly of sufficient pump elements to form a multi-element unit as needed.

Referring now to the drawings, a charge-forming device in accordance with the invention comprises an upper pump housing 1, a lower pump housing 2 and a front cover 3. The housing members 1, 2 and 3 are preferably made of a suitably rigid material and serve as a foundation and enclosure for the charge-forming device and for alignment of its internal parts. The housing also serves to mount the charge-forming device to the engine with which it is to be used.

A valve block 4 disposed above the upper pump housing 1 comprises an inlet suction valve 4A and an outlet discharge valve 4B. The inlet valve 4A and outlet valve 4B can be threaded to provide suitable connections for respective fuel supply and discharge lines.

A plunger barrel 5 is threaded into the valve block 4 via threads machined into the upper end of the circumference of the plunger barrel 5 which mate with corresponding threads in the valve block 4. A shoulder is machined on the lower end of the plunger barrel 5 which mates with a spanner ring nut 9 as will hereinafter be described. The plunger barrel 5 is also provided, on its circumference, with two parallel opposed flat surfaces by which the plunger barrel 5 may be grasped for rotation when it is screwed into the valve block 4.

The plunger barrel 5 has a cylindrical bore, containing no grooves or ports, along its longitudinal axis. A plunger 6 has a cylindrical stem 6A which has a diameter just slightly less than that of the bore in the plunger barrel 5 and a cylindrical shoulder 6B at its lower end. The plunger stem 6A is slidably received within the bore of the plunger barrel 5 with minimal clearance between the respective circumferences of the stem 6A and bore of the plunger barrel 5.

A plunger guide 7 having a cylindrical bore and a seat for the plunger barrel 5 is of unitary construction. The seat is formed in the upper end of the plunger guide 7 by machining a recess in its upper surface which receives the shoulder portion of the plunger barrel 5.

The plunger shoulder 6B is dimensioned for a sliding fit within the smoothly machined bore of the plunger guide 7. A plunger coil spring 8 which fits over the stem 6A of the plunger 6 and within the bore of the plunger guide 7 is located and compressed between the bottom of the plunger barrel 5 and the shoulder 6B at the lower end of the plunger 6.

The spanner ring nut 9 is fitted over the plunger barrel 5 before the plunger barrel 5 and valve block 4 are joined by threading the plunger barrel 5 into the valve block 4. The spanner ring nut 9 is threaded into the upper pump housing 1 as can readily be seen in the drawings. The spanner ring nut 9 securely locates, in concentric alignment, the plunger barrel 5, the plunger 6, and the plunger barrel seat and guide 7.

A plunger cup 10 receives the lower end of the plunger 6 with the shoulder portion 6B of the plunger 6 urged by the spring 8 downwardly into contact with the floor of the plunger cup 10. The upper portion of the plunger cup 10 is provided with a lip 10A which rests upon the prong-like arms 11a of a metering yoke 11.

The metering yoke 11 is mounted on a metering yoke shaft 12 for rotation with respect to the upper pump housing 1. The metering yoke 11 operates similarly to a bell crank. It has a forked portion containing two arms **11*a* upon which the lip 10*a* of the plunger cup 10 is seated and another arm 11b substantially transverse to the forked arms 11*a* which is urged against a metering control cam 13 by the weight of the arms 11a and downward forces exerted on the arms 11*a* by the plunger cup lip 10*a*. The forked arms 11*a* of the metering yoke 11 support the plunger cup 10 which in turn supports the plunger 6. The lever arm 11*b* of the metering yoke 11 tangentially contacts the circumference of the metering control cam 13 for adjustment of the height at which the plunger cup 10 and plunger 6 are supported which height is determinative of the outer position of the plunger 6**.

Figure 4:
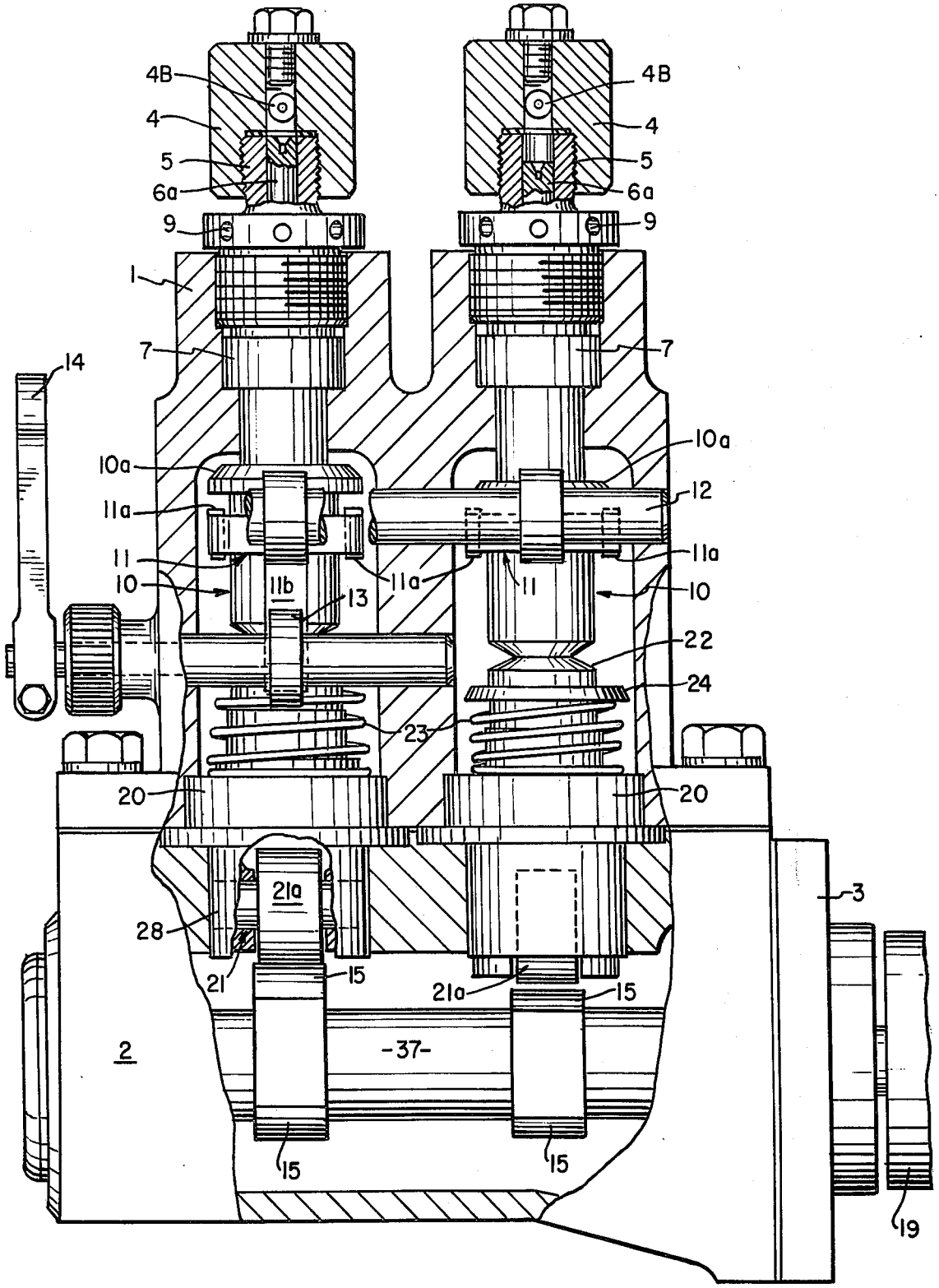
FIG. 4 is a front elevation with parts broken away of multiple charge-forming devices in accordance with the invention for use in a multi-cylinder engine.

When charge-forming devices of the type herein described are used with multi-cylinder engines, as shown in FIG. 4, a common metering yoke 11 having multiple forked portions, that is, pairs of arms **11*a*, one pair for each plunger element corresponding to each cylinder, rotatable on a common shaft 12** is used thereby insuring that all plunger elements have an equal stroke at any given metering setting.

The shaft 12 on which the metering control cam 13 is mounted is rotatably supported by two bearings within the pump housing. One end of the metering control cam shaft 12 extends from the pump housing and has affixed to it a governor lever 14. The governor lever 14 is used to rotate the metering control cam to control the fuel discharge capacity of the pump. Thus, as the governor lever 14 is moved, the metering control cam 13 rotates on the shaft 12 thereby causing the lever arm 11b of the metering yoke 11 to rotate about the axis of the metering yoke shaft 12.

Figure 3:
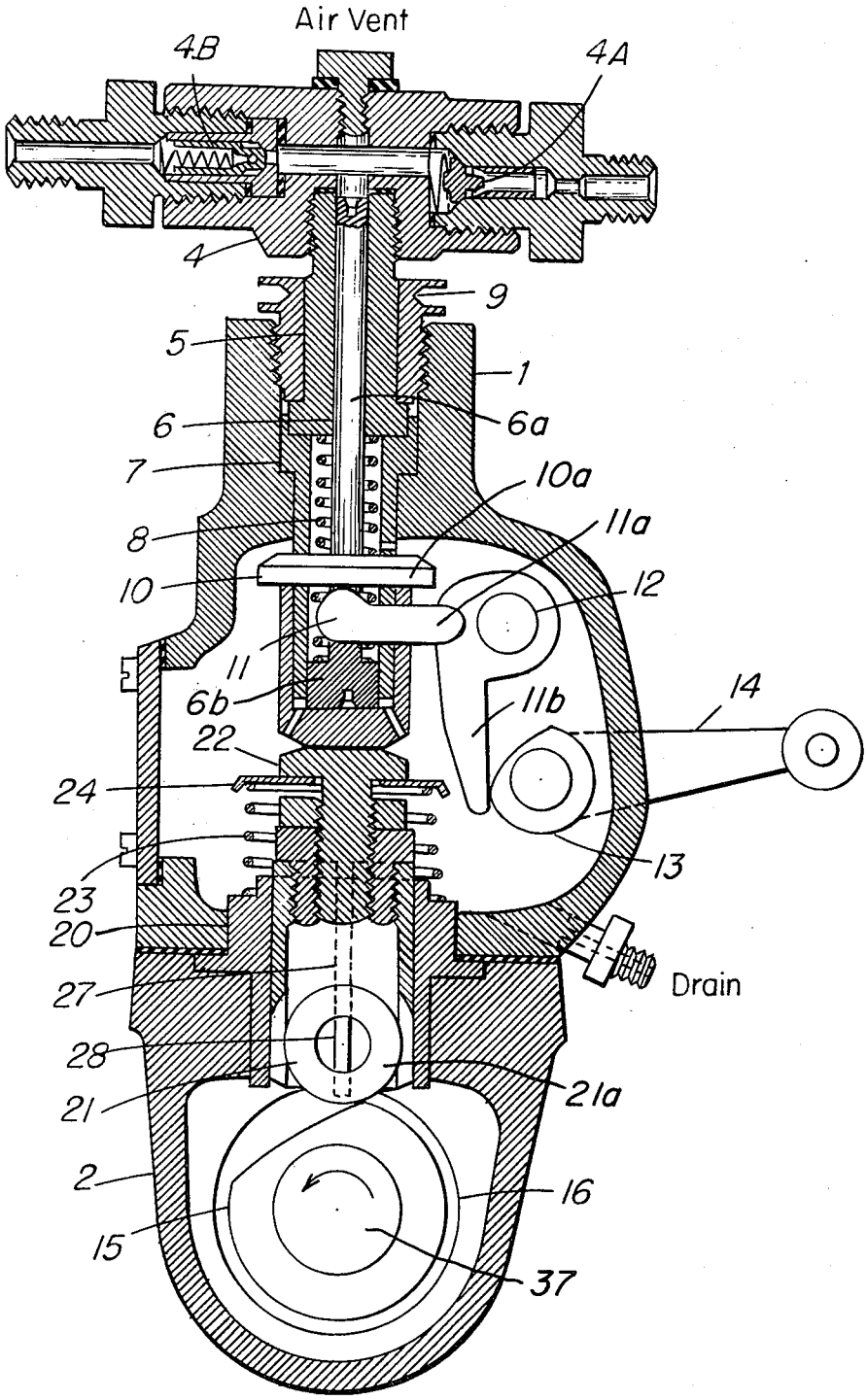
FIG. 3 is a side sectional elevation of the charge-forming device of the invention similar to FIG. 2 with the fuel metering governor in its minimum fuel intake position.

As the metering yoke 11 rotates about the axis of the shaft 12, the forked portion **11*a* of the metering yoke moves upwardly or downwardly depending upon the direction of rotation. For example, in the view of FIG. 3, when the governor lever 14 is raised, the flattened portion of the metering control cam 13 is moved into contact with the lever arm 11*b* of the metering yoke 11. The lever arm 11*b* of the metering yoke 11 is urged against the metering control cam 13 by the downward force attributable to the weight of the plunger 6 and plunger cup 10 and the downward force of the spring 8 against the plunger cup 6. Thus, the lever portion 11b of the metering yoke 11 moves toward the axis of the metering control cam shaft resulting in downward rotation of the forked portion 11a of the metering yoke 11 and corresponding downward movement of the plunger cup 10 and plunger 6 thereby increasing the fuel discharge capacity of the pump. Similarly, when the governor lever 14 is moved downward, the rounded portion of the metering control cam 13 urges the lever portion 11*b* of the metering yoke 11 away from the axis of the metering control cam shaft 12 thereby forcing the forked portion 11*a* of the metering yoke 11 upwardly against the downward force of the plunger cup 10** and consequently reducing the fuel discharge capacity of the pump.

The lower pump housing 2 has secured to it by six screws the front cover 3. The front cover 3 supports a front ball bearing 17 and a shaft seal 18. The front cover 3 is utilized in mounting the pump of the invention on the combustion engine with which it is to be used.

A plunger drive cam 15 is mounted on a plunger drive shaft 37 which is rotatably mounted on ball bearings 16 and 17. A cam follower guide 20 having a cylindrical bore is press-fitted into an opening in the lower pump housing 2 and receives, about its circumference, the upper pump housing 1. The cam follower guide 20 aligns the upper and lower pump housings with respect to a common vertical axis.

A roller cam follower 21 is slidable within the bore of the cam follower guide 20 and includes a roller 21*a* which is urged downwardly against the circumference of the plunger drive cam 15. A guide pin track 27 slidably receives a guide pin 28 on which a shaft about which the roller 21 rotates is mounted.

A tappet screw 22 is threaded into a lock nut on the top of the cam follower 21 to form a cam follower assembly. The head of the tappet screw 22 urges the plunger cup 10 upwardly when the rounded portion of the plunger drive cam 15 is in contact with the roller 21*a*. The tappet screw moves axially with respect to the cam follower 21 as it is rotated with respect thereto. This permits adjustment of the length of the cam follower assembly to control the degree of clearance above the stem 6*a* of the plunger 6 when the plunger 6 is at the terminus of its discharge stroke as shown in FIG. 1, that is when the plunger is in its innermost position.

A cam follower lift spring 23 engages a floating lift spring collar 24 located beneath the head of the tappet screw 22. The force of the spring 23 against the collar 24 urges the cam follower assembly upward against the bottom of the plunger cup 10.

The plunger spring 8 opposes the force of the cam follower lift spring 23. The plunger spring 8 is selected so that it overpowers the cam follower lift spring 23. As a result of this relationship between the springs 8 and 23, the plunger 6 and plunger cup 10 are permitted to move downward with the cam follower 21 as the roller of the cam follower 21 descends the rotating ramp or flattened portion of the plunger drive cam 15 until the lip 10*a* of the plunger cup 10 engages the arms 11a of the metering yoke 11.

As the plunger drive cam 15 rotates, it causes the cam follower 21 to occupy an upward position when the roller portion of the cam follower 21 is in contact with the circular portion of the circumference of the plunger drive cam 15, and the roller cam follower 21 to move downwardly and occupy a lower position as the roller comes in contact with the flattened portion of the plunger drive cam 15.

A drive gear 19 is secured to the shaft 37 upon which the plunger drive cam 15 is mounted by a keyed fit. A cam shaft nut 25 holds the drive gear 19 in place on the cam shaft 37. The drive gear 19 is adapted to mate with a driving gear (not shown) on the engine so that the engine may cause the plunger drive cam 15 to rotate to operate the pump.

The upper pump housing 1 and lower pump housing 2 are securely held together by four studs on which there are threaded four nuts. The secured combination of the upper and lower pump housings forms a rigid self-supporting unit.

Operation of the pump for forming a fuel charge for injection into a combustion engine will now be described. The pump is drivingly connected to the combustion engine with a driving gear on the combustion engine mating with the pump drive gear 19. The mating is such that there is a proper timed relation between the fuel intake cycle of the engine and the injection of fuel from the pump into the engine.

Figure 2:
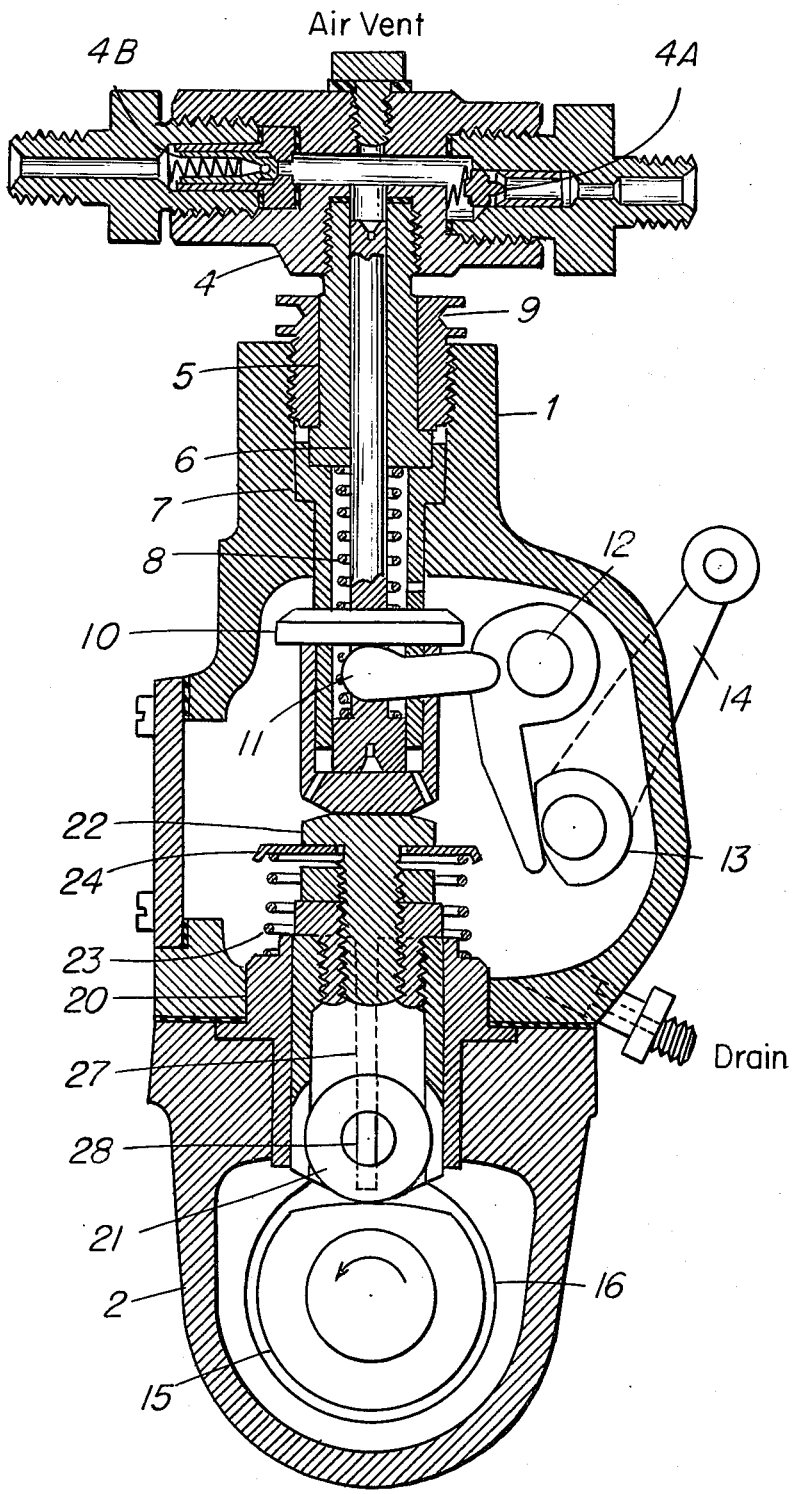
FIG. 2 is a side sectional elevation of the charge-forming device of the invention with the valve block assembly rotated ninety degrees and the fuel metering governor adjusted for maximum fuel intake.

Prior to starting of the engine, the governor lever 14 is moved to its maximum upward position which is the start position as shown in FIG. 2. This allows the lever arm 11*b* of the metering yoke 11 to contact the low point of the circumference of the metering control cam 13 as is shown in FIG. 2. In this position, the forked portion 11*a* of-the metering yoke 11 is at its lowermost point thereby permitting maximum downward displacement of the plunger 6 and plunger cup 10, and hence the maximum stroke of the plunger 6.

The drive gear 19, upon being turned by the combustion engine as the engine is cranked for starting, causes the plunger drive cam 15 to rotate. As the descending ramp or flattened portion of the plunger drive cam 15 registers with the roller 21a on the cam follower 21, the plunger spring 8 urges the plunger 6 and plunger cup 10 downward toward the axis of the plunger drive cam 15 until downward movement is arrested by contact of the lip 10a of the plunger cup 10 with the forked portion 11a of the metering yoke 11. The point of transition from the circular portion of the plunger drive cam to the flattened portion defines the end of the dwell angle of the pump.

The dwell angle of the pump is defined as the angle through which the plunger drive cam 15 rotates with the plunger 6 detained at the upper terminus of the discharge stroke, that is at its innermost position within the bore of the plunger guide 5. The dwell time is defined as the time it takes the plunger drive cam 15 to rotate through the dwell angle. As thus defined, the approximate dwell angle of plunger drive cams 15 for multi-element charge-forming devices according to the invention are as follows:

| Number of elements (e.g. number of cylinders) | Dwell angle (degrees) |
|---|---|
| 2 | 180 |
| 3 | 240 |
| 4 | 270 |
| 5 | 288 |
| 6 | 300 |
| 8 | 315 |

As can be seen from the foregoing, the general relationship between number of elements (e.g. cylinders) and dwell angle can be generally stated as $$\text{dwell angle} = 360° - \frac{360°}{\text{number of elements}}$$

or if dwell angle is to be expressed in radians, $$\text{dwell angle} = 2\pi - \frac{2\pi}{\text{number of elements}}.$$

Consequently, the angle subtended by the flat or truncated portion of the plunger drive cam 15 is equal to 360° or $2\pi$ radians minus the dwell angle since a full revolution of the plunger drive cam 15 constitutes 360° or $2\pi$ radians. In the case of a single element engine used with a charge-forming device of the invention, dwell angles of 180° and 270° have both been found satisfactory.

As the descending ramp presented by the flattened portion of the plunger drive cam 15 registers with the cam follower roller 21*a*, the plunger spring 8 urges the plunger 6 and plunger cup 10 downward, with the roller 21*a* descending the rotating ramp, until the underside of the lip 10*a* of the plunger cup 10 engages the forked arm portion 11*a* of the metering yoke 11. The cam follower 21 is urged downward by the force of the spring 8.

The space left above the downward moving plunger 6 fills with fuel which enters through the inlet 4A in the valve 4 after which the fuel inlet valve 4A closes.

As engine cranking continues, the roller 21a of the cam follower 21 begins to ascend the flattened portion of the plunger drive cam forcing the cam follower 21, plunger cup 10 and plunger 6 upwardly which upward movement constitutes the discharge stroke of the pump. The terminus of the discharge stroke is reached when the roller 21*a* of the cam follower 21 engages the transition between the flattened portion of the plunger drive cam 15 and its circular portion. This point of transition is the start of the dwell angle previously defined. During the upper travel of the plunger 6, fuel contained in the space above the plunger 6 is forced from the chamber in the valve block 4 through the discharge or outlet valve 4B to a fuel injection valve and into the engine cylinder.

The foregoing cycle of events is repeated until the engine starts. Once the engine is started, the engine governor can be employed to reposition the metering control cam 13 as previously described in order to adjust the fuel discharge capacity to satisfy the needs of the engine. Thus, the governor control 14 can be swung downward causing the metering yoke 11 to be located so that the forked arms 11a raise the downward limit of travel of the plunger cup 10 thereby in turn limiting the intake stroke of the plunger 6 and lessening the capacity of the space above the plunger 6 for receiving fuel for a following discharge cycle.

To stop the engine once it is running, the governor lever is manually positioned at its stop setting at the extreme downward position. At this point, the metering yoke lever 11*b* is in contact with the highest point on the circumference of the metering control cam 13. The fork-like arms of the metering yoke 11 are thus rotated upwardly to their maximum height thereby lifting the plunger cup 10 and plunger 6 above the operating terminus of the discharge stroke of the cam follower assembly. At this point, the cam follower lift spring 23 raises the cam follower 21 an amount sufficient to break contact between the roller of the cam follower 21 and circumference of the plunger drive cam 15. A clearance is thus created between the roller 21*a* of the cam follower 21 and the plunger drive cam 15 which is adjustable by rotation of the tappet screw 22 mounted on the cam follower 21. The clearance prevents reciprocating motion from being imparted by the plunger drive cam 15 to the cam follower 21, and the plunger 6 remains stationary with the plunger cup 10 supported on the metering yoke 11 thereby preventing all fuel delivery to the engine and resulting in stoppage of the engine.

It will be appreciated that the foregoing description of a preferred embodiment discloses only one of many possible embodiments of the invention the scope of which is to be limited only by the claims which follow this disclosure.

As herebefore noted, the invention may be used with a rotary engine, e.g., a Wankle engine. In the environment of a rotary engine a complete pump element is driven in a direct manner, at the same rotational speed as the rotors and a fuel injection spray valve and with associated piping is provided for each individual rotor. A plunger drive cam 15, with three identical cam lobes, placed at 120 degree intervals about the circumference is provided for each plunger element. The cam 15 for each plunger element is placed on the shaft 37 in relation to each adjacent plunger cam to cause the individual cam lobes to alternately actuate each plunger element, and discharge fuel in proper sequence with the rotor firing order. The angular displacements of each plunger drive cam 15 with respect to its adjacent cam 15 for rotary engines with plural, three lobe or three chamber rotor stages are as follows:

| Rotor Stages | Angular Displacement (cams 15) |
|---|---|
| 1 | 120 Degree |
| 2 | 60 Degree |
| 3 | 40 Degree |
| 4 | 30 Degree |

What I claim is:

1. A charge forming device for pumping a predetermined quantity of fuel to an internal combustion engine and including means to prevent hydraulic blockage, said device comprising:

a chamber having an inlet valve for opening when the pressure in said chamber is less than a predetermined pressure and an outlet valve for opening when the pressure in said chamber exceeds a predetermined pressure, a plunger for drawing fuel into said chamber through said inlet valve by translating from an innermost position outwardly towards an outermost position and for compressing fuel in said chamber by translating from an outer position inwardly to said innermost position;

a cam for reciprocating said plunger in said chamber, said cam having a periphery defining a circular sector of substantially constant radius of curvature for maintaining said plunger at said innermost position, a truncated sector for translating said plunger from said innermost position to said outermost position and substantially immediately translating said plunger from said outermost position to said innermost position;

means for connecting said cam to said plunger; and means for variably terminating the outward translation of said plunger at or inwardly of said outermost position so that said plunger translates from its normal dwell at said innermost position to said outer position to draw a predetermined quantity of fuel into said chamber and presently translates from said outer position to said innermost position to discharge said fuel through said outlet valve, said terminating means including a yoke, a remotely controlled governor for positioning said yoke, said cam acting to maintain the plunger toward its innermost position of translation whereby said governor can freely adjust said yoke without interference from the plunger, and a cup affixed to said plunger for engaging said yoke during the outward translation of said plunger and thus terminating said outward translation.

2. A charge forming device as in claim 1 including:

a first spring bearing on said plunger for biasing said plunger toward said cam.

3. A charge forming device as in claim 1 wherein said connecting means comprises:

a cam follower;

a second spring bearing on said cam follower for biasing said cam follower against said plunger so that said cam follower always abuts said plunger.

4. A charge forming device for pumping a predetermined quantity of fuel to an internal combustion engine having a plurality of cylinders and including means to prevent hydraulic blockage, said device comprising:

a plurality of chambers, each having an inlet valve for opening when the pressure in said chamber is less than a predetermined pressure and an outlet valve connected to a different one of said cylinders for opening when the pressure exceeds a predetermined pressure;

a plunger in each of said chambers for drawing fuel into said chamber through said inlet valve by translating from an innermost position outwardly towards an outermost position and for compressing fuels in said chamber by translating from an outer position inwardly to said innermost position;

a plurality of cams for reciprocating said plungers in said chambers, each of said cams having a periphery defining a circular sector of substantially constant radius of curvature for maintaining said plungers at said innermost position and a truncated sector for translating said plungers from said innermost position to said outermost position and substantially immediately translating said plungers from said outermost position to said innermost position, said circular sector subtending an angle equal to $2\pi$ radians divided by the number of said cams;

means for connecting each of said cams to a different one of said plungers;

means for rotating said cams to cause only one of said plungers to translate inwardly and outwardly at a time;

means for variably terminating the outward translation of said plungers at or inwardly of said outermost position, such that each of said plungers in its turn translate from its normal dwell at said innermost position to an outer position for drawing a predetermined quantity of fuel into said chamber and presently translates from said outer position to said innermost position to discharge said fuel from said chamber through the outlet valve into the connected cylinder of said engine, said terminating means including a yoke, a remotely controlled governor for positioning said yoke, said cams acting to maintain each respective plunger toward its innermost position of translation whereby said governor can freely adjust said yoke without interference from the plunger, and a cup affixed to each plunger for engaging said yoke during the outward translation of each said plunger and thus terminating said outward translation.

5. A method of pumping a predetermined quantity of fuel to an internal combustion engine without resistance from hydraulic blockage including the following steps:

maintaining a plunger in a chamber, having an inlet valve that allows fuel to flow into said chamber when the pressure in said chamber is lower than a predetermined pressure and an outlet valve that allows fuel to flow out of said chamber when the pressure in said chamber exceeds a predetermined amount, at an innermost position of translation;

determining an outer position for said plunger by adjusting a governor linked to a yoke acting as a stop for said plunger while said plunger is in said innermost position and not in contact with said yoke;

outwardly translating said plunger from said innermost position towards an outermost position for drawing fuel into said chamber at a predetermined time before said chamber is to deliver fuel to said engine, said predetermined time substantially equal to the time required to translate said plunger from said innermost position to said outermost position;

terminating the outward translation of said plunger at said yoke for metering a predetermined quantity of fuel into said chamber; and inwardly translating said plunger to said innermost position.

* * * * *